United States Patent [19]

Torisaka et al.

[11] Patent Number: 4,867,807

[45] Date of Patent: Sep. 19, 1989

[54] METHOD FOR SUPERPLASTIC WARM-DIE AND PACK FORGING OF HIGH-STRENGTH LOW-DUCTILITY MATERIAL

[75] Inventors: Yasunori Torisaka; Masahito Katoh; Yoshinori Nakawawa, all of Ibaraki, Japan

[73] Assignee: Agency of Industrial Science & Technology, Ministry of International Trade & Industry, Tokyo, Japan

[21] Appl. No.: 938,468

[22] Filed: Dec. 5, 1986

[30] Foreign Application Priority Data

Dec. 5, 1985 [JP] Japan ..... 60-274105

[51] Int. Cl.[4] ..... C21D 8/04

[52] U.S. Cl. ..... 148/11.5 R; 148/11.5 F; 148/11.5 N; 148/11.5 P; 420/902

[58] Field of Search ..... 148/2, 11.5 R, 11.5 F, 148/11.5 N, 11.5 P; 420/902

[56] References Cited

U.S. PATENT DOCUMENTS 4,600,446 7/1986 Torisaka et al. ..... 148/2

FOREIGN PATENT DOCUMENTS 84635 5/1983 Japan ..... 148/11.5 R

*Primary Examiner*—L. Dewayne Rutledge
*Assistant Examiner*—George Wyszomierski
*Attorney, Agent, or Firm*—Oblon, Fisher, Spivak, McClelland & Maier

[57] ABSTRACT

A high-strength low-ductility material is formed by a method which comprises treating a bulk or powder of the material thereby converting coarse grains thereof into hyperfine grains capable of manifesting superplasticity when the strain rate is higher than $5\times10^{-3}\ s^{-1}$, enclosing the treated material with a metallic insulating member, heating the material to a temperature for manifestation of superplasticity, and forging the material by the use of a die in a state heated to a temperature beyond which the die yields to heat.

12 Claims, 6 Drawing Sheets

B.F.=435

B.F.=530

B.F.=400

10mm

METHOD FOR SUPERPLASTIC WARM-DIE AND PACK FORGING OF HIGH-STRENGTH LOW-DUCTILITY MATERIAL

FIELD OF THE INVENTION AND RELATED ART STATEMENT

This invention relates to a method for the superplastic warm-die and pack (SWAP) forging of a high-strength low-ductility material by virtue of the superplasticity inherent in the material.

In the gas turbine engine field, for example, the engine design requires use of alloys which possess satisfactory high-temperature strength and highly stable resistance to oxidation-corrosion. A number of alloys have been developed and put to use to meet this need. They have satisfied the requirement for high-temperature strength generally at a sacrifice of the workability of the alloy. In the manufacture of a jet engine which consists of thousands of parts molded in complicated shapes in conformity with strict tolerances, however, the workability of a given alloy constitutes an important factor in deciding the degree of utility of the alloy. In many industries, this problem of workability can be solved conveniently by changing the composition of an alloy. The relevant standards imposed on an alloy to be used for the gas turbine engine, however, are so numerous that improvement in the method of working itself will be an inevitable necessity no matter whether the composition of the alloy may be changed or not.

Heretofore, the Gatorizing method has been known as a means of working a high-strength low-ductility material such as, for example, a Ni-base superalloy by effective use to the superplasticity inherent in the alloy. This method requires an isothermal forging which consists in equalizing the temperature of both a worked material and dies. Further since the Ni-base high-strength low-ductility material generally cannot be given the superplastic working unless it is heated to a temperature exceeding 1,000° C., this method entails the necessity of using for the working a die made of TZM (a Mo-base alloy containing 0.5% of Ti and 0.1% of Zr) which is capable of withstanding such a high temperature as mentioned above.

TZM is expensive. Moreover, since the alloy has a serious drawback of high susceptibility to oxidation at elevated temperatures, the forging must be carried out under a vacuum or under a blanket of inert gas and, as an inevitable consequence, the forging system as a whole becomes quite voluminous.

The inventors formerly proposed a method for forging a high-strength low-ductility material, comprising the steps of preparing extremely fine wires of the material, bundling a multiplicity of such fine wires in a bulk, forming this bulk of fine wires in a prescribed shape, and subjecting the formed article made up of hyperfine grains to a heat treatment at the secondary recrystallization temperature thereby allowing the hyper-fine grains to grow along the zone for inhibiting grain growth (U.S. Pat. No. 4,600,446).

OBJECT AND SUMMARY OF THE INVENTION

An object of this invention is to provide a method for SWAP forging of a high-strength low-ductility material, which is very simple to perform as compared with the Gatorizing method heretofore known to the art. To accomplish the object described above, the method of SWAP forging according to this invention comprises enclosing with an insulating metal a high-strength low-ductility material prepared in the form of a bulk or a powder and preheated to have grains thereof converted into hyperfine sizes capable of manifesting superplasticity when the strain rate is higher than $5\times10^{-3}$ $s^{-1}$, heating the bulk or powder of material to a temperature high enough for the material to manifest superplasticity, and thereafter forging the material in the superplastic state by the use of a die kept heated at a temperature falling in the range of 200° C. to 950° C. and not exceeding the level at which the die yields to heat.

Owing to the fact that the pretreatment of the high-strength low-ductility material for conversion of coarse grains thereof into hyperfine grains permits elevation of the strain rate at which the material acquires the maximum strain rate-sensitivity index, the forgin method of this invention shortens the time required for the alloy to be retained in the heated state prior to the forging and enables the low-ductility material to be easily worked in the open air without necessitating use of an expensive die of TZM and without requiring the site of forging to be enveloped in a vacuum or in a blanket of inert gas.

The other objects and characteristics of this invention will become apparent from the description to be given in detail below with reference to the accompanying drawings.

DETAILED DESCRIPTION OF THE PREFERRED EMBODIMENTS

Figure 1:
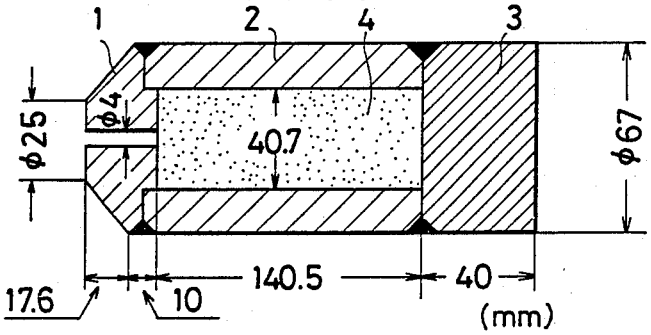
FIG. 1 is a cross section illustrating the shape of a billet before being extruded.

The inventors have found that when a high-strength low-ductility material such as, for example, a Ni-base superalloy is extruded at a temperature not exceeding the $\gamma'$-resolved temperature and falling within 150° C. thereof at a reduction of area of not less than 70% and subsequently annealed at a temperature not exceeding the $\gamma'$-resolved temperature and falling within 150° C. thereof, the average diameter of the grains thereof can be decreased to the order of about 1.5 $\mu$m and that the material which has 1.5 $\mu$m grain size exhibits the maximum strain rate-sensitivity index (hereinafter referred to as "m value" for short) at temperatures in the range of 1,050° C. to 1,100° C. at a notably high strain rate of about $2.5\times10^{-2}$ $s^{-1}$, whereas the ordinary Ni-base superalloy exhibits the m value at a strain rate of about $2\times10^{-3}\,s^{-1}$.

The fact that the large m value is obtained at the strain rate of $2.5\times10^{-2}\,s^{-1}$ means that, when a specimen 50 mm in overall height is to be compressed to a thickness of 15 mm by forging, the conventional Gatorizing method requires about 5 minutes' forging time at the strain rate proper thereto and, therefore, has no alternative but to rely on the isothermal forging at temperatures from 1,050° to 1,100° C., whereas the method of this invention is capable of completing this work of compression in about 30 seconds, roughly one-tenth of the aforementioned time and is only required to retain the specimen in the aforementioned temperature range for this shortened forging time. Thus, the method of this invention obviates the necessity for performing the isothermal forging, using an expensive die of TZM, or utilizing a voluminous vacuum chamber for protecting TZM against oxidation due to exposure to the open air.

The forging method of the present invention can be effectively applied to all the materials that can be worked by the Gatorizing method, It can be worked on not merely such Ni-base alloys as IN-100 (the major alloying elements of which are 10% by weight of Cr, 15% by weight of Co, 3% by weight of Mo, 5.5% by weight of Al and 4.7% by weight of Ti), MAR-M-200 (the major alloying elements of which are 9.8% by weight of Cr, 11.1% by weight of Co, 12.8% by weight of W, 5.2% by weight of Al, 2.1% by weight of Ti, and 1.0% by weight of Nb; MAR-M is a registered trademark owned by Martin Marietta Corp.), and Rene 95 (the major alloying elements of which are 14% by weight of Cr, 8% by weight of Co, 3.5% by weight of Mo, 3.5% by weight of W, 3.5% by weight of Al, 2.5% by weight of Ti and 3.5% by weight of Nb; Rene is a registered trademark owned by General Electric Co.) and such Ti-base alloys as Ti-6Al-4V but also high. speed tool steel, ultra high carbon steel, and $\delta/\gamma$ duplex steel.

For the grain of a high-strength low-ductility material to be converted into hyperfine sizes capable of manifesting superplasticity at the aforementioned high strain rate, namely, exhibiting a large m value, the method which comprises subjecting this material to plastic deformation in a heated state and subsequently annealing the deformed material at a recrystallization temperature can be utilized. This treatment for the conversion of the coarse grains into the hyperfine grains is desirably effected to such an extent that the produced hyperfine grains will have as fine diameter as possible, such as a fes $\mu$m, preferably not more than about 3 $\mu$m.

More specifically, in the case of a low-ductility material such as, for example, a Ni-base alloy containing about 60% or more of gamma-prime ($\Gamma'$), the crystal grains thereof are converted into hyperfine grains of diameters not exceeding 1.5 $\mu$m when the material is extruded in a temperature range of 1,080° to 1,120° C. in a reduction of area of not less than 70% and subsequently annealed at a temperature in the range of 1,050° to 1,100° C.

The method has been described as applied to the material in the form of a bulk. It can also be applied directly to a powder obtained by a rapid cooling treatment and consequently made up of hyperfine grains of diameters of not more than 1 $\mu$m.

Preparatory to the forging of the high-strength low-ductility material, the material is enclosed with an insulating metal and then heated to a temperature for manifestation of superplasticity and the die to be used for the forging is heated to a temperature falling in the range of 200° to 950° C. and not exceeding the level at which the die yields to the heat. This treatment is intended to maintain the material at the temperature necessary for the superplastic forging until the forging is completed. It is from this point of view that the various conditions such as the extent to which the high-strength low-ductility material is to be enclosed with the insulating metal and the temperature to which the die is to be heated are determined.

The enclosure of the material with the insulating metal is mainly aimed at maintaining the material at the temperature for manifestation of superplasticity during the time of forging as described above. So long as the insulating metal fulfills this object, it is not required to enclose the material completely. At times, it suffices for the insulating metal to provide partial enclosure for the material such that only the peripheral sides of the material will be encircled and the upper side and the lower side thereof will be left exposed to the open air.

To be specific, the forging is effected by enclosing the low-ductility material mechanically with a Fe type alloy such as medium carbon steel or stainless steel which possesses a fairly high degree of ductility and a strength equal or inferior to that of the material of the die, heating the material to the temperature for manifestation of superplasticity, setting the hot material between upper and bottom dies heated in advance to a temperature of not higher than 950° C., and applying required pressure to the dies. While the upper limit of the temperature to which the dies are heated is 950° C., it can be freely lowered by suitably adjusting the thickness of the enclosing material. When the thickness of the enclosing material is about 5 mm, for example, the lower limit of the temperature of the dies can be lowered even to about 500° C. In this case, the dies are required to be made of a material having the aforementioned temperature as the upper limit beyond which the die material yields to heat.

When a specimen in the form of a powder made up of hyperfine structures is to be forged, the insulating metal to be used is in the shape of a capsule. The forging is effected by filling this capsule with the powdery specimen, deaerating the mass of this powdery material for prevention of oxidation, tightly sealing the capsule, heating the powdery material in combination with the capsule to the temperature for the manifestation of superplasticity, setting the hot material similarly to the bulky material between the preheated upper and bottom dies, and applying desired pressure to the dies. In the forging of a powdery specimen, therefore, the insulating metal fulfills the dual purpose of insulating the specimen and retaining the shape of the specimen during the course of the forging. The insulating material, therefore, is required to be made of such a material in such a shape that it will withstand the impact of the consolidation of the material under treatment.

Then, the product of the superplastic forging is given a heat treatment for coarsening the grains. This treatment is aimed at increasing the high-temperature creep strength. In the case of a Ni-base alloy, this treatment is effected by annealing the product at a temperature not lower than 1,150° C. for several hours thereby adjusting the grain sizes thereof to diameters of not less than about 20 $\mu$m.

After the forging treatment or after the aforementioned treatment for coarsening grains, the insulating metal wrapped around the material can be easily removed either by a chemical method which consists in immersing the material as enclosed with the insulating metal in dilute nitric acid or by a mechanical method which consists in grinding the insulating metal.

As is noted from the foregoing description, in the present invention, the strain rate at which the high-strength low-ductility material acquires the maximum m value is increased by treating the material so as to convert coarse grains thereof into hyperfine grains. This material is heated to the temperature for manifestation of superplasticity and subsequently formed in a die. Owing to the fact that the aforementioned alloy is thoroughly or partially enclosed with the insulating metal and the die also is kept in a heated state, coupled with the fact that the time of forging is shortened in consequence of the aforementioned elevation of the strain rate, the alloy is minimally cooled and is maintained at a temperature sufficiently high for forging throughout the entire period of forging.

By the SWAP method of the present invention, therefore, the forging can be effected without using an expensive die of TZM and it can be carried out in the open air without requiring use of a voluminous vacuum system otherwise indispensable to the prevention of TZM from oxidation. In the case of a powdery specimen, the material can be forged and at the same time consolidated. Thus, this invention contributes greatly to the industries.

Now, the present invention will be described more specifically below with reference to working examples.

EXAMPLE 1

In the atmosphere, a capsule of SUS 304 (1.5 mm to 2.5 mm in wall thickness) was filled in a real density ratio of about 65% with an atomized powder of Mod. IN-100–325 mesh in particle size made by Homogeneous Metals Inc. of the U.S.A. and having a composition indicated in Table 1.

TABLE 1

(Weight %)

| | | | | | |
|---|---|---|---|---|---|
| C | Si | Mn | P | S | Cu |
| 0.063 | <0.05 | <0.008 | <0.005 | <0.003 | <0.002 |
| Ni | Cr | Mo | Co | Ti | Al |
| Bal. | 12.43 | 3.40 | 18.36 | 4.27 | 4.84 |
| Nb | Hf | Zr | B | W | Fe |
| (trace) | (trace) | 0.053 | 0.023 | 0.03 | 0.088 |
| V | Cd + Ta | Pb | Bi | O | N |
| 0.650 | <0.02 | <0.1 | <0.2 | 103 | 23 |
| | | (ppm) | (ppm) | (ppm) | (ppm) |

Figure 2:
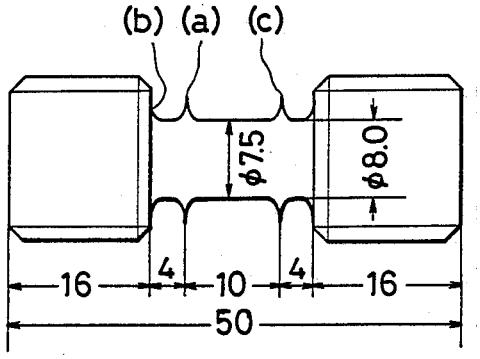
FIG. 2 is a front view illustrating the shape of a specimen for superplastic test.

The mass of atomized powder in the capsule was evacuated to $5\times10^{-3}$ Torr and then tightly sealed. The filled capsule was subjected to hot hydrostatic press (HIP) treatment under the conditions of 1,100° C.×91.2 MPa ×1 h. Then, for the adjustment of the degree of working and for the protection of the die during the course of extrusion, the specimen was again cased with a capsule of S35C having the dimensions indicated in FIG. 1, extruded at a ram speed of 20 mm.s$^{-1}$ and annealed to prepare a Ni-base superalloy made up of hyperfine grains. In FIG. 1, 1 and 2 respectively stand for a front lid and a barrel both made of S35C, 3 stands for a rear lid made of SUS 304, and 4 stands for a specimen being worked.

The conditions for the extrusion performed for impartation of plastic deformation and the conditions for the subsequent annealing are shown in Table 2.

TABLE 2

| Material | Preform | Annealing | Average grain diameter |
|---|---|---|---|
| A | As HIP | — | 4–5 μm |
| B | 82% extruded at 1000° C. | 1150° C. × 60 min | 3.9 μm |
| C | 82% rolled at 850° C. | 1150° C. × 60 min | 3.9 μm |
| D | 72% extruded at 1100° C. | 1070° C. × 60 min | 1.5 μm |
| E | 82% extruded at 1100° C. | — | — |
| F | 72% extruded at 1100° C. | — | — |
| G | 72% extruded at 1100° C. | 1275° C. × 15 min | 5.9 μm |
| H | 82% extruded at 1150° C. | — | 3.9 μm |

It is noted from Table 2 that the grains had a diameter of 1.5 μm in a material obtained by extruding the material at a ratio of 72% at 1,100° C. and subsequently annealing the extruded material at 1,070° C. for 60 minutes (Material D), whereas the grains had diameters invariably exceeding 3.9 μm in materials obtained by performing extrusion and annealing under conditions different from those shown above (Materials B, C, G, and H).

Then, specimens each of the dimensions shown in FIG. 2 were cut out of the materials resulting from the treatment described above. In FIG. 2, the points "a", "b", and "c" each indicate the position of a thermocouple. The temperature control was effected at the point "a". The distance between the marks, i.e. the projections at the two positions, was 10 mm. By the use of a high-temperature grade servo pulser provided with a vacuum chamber and operated by high-frequency heating, a given test piece was heated to a fixed temperature of 1,050° C. and retained at this temperature for 10 minutes and then tensed at a constant crosshead speed.

Figure 3:
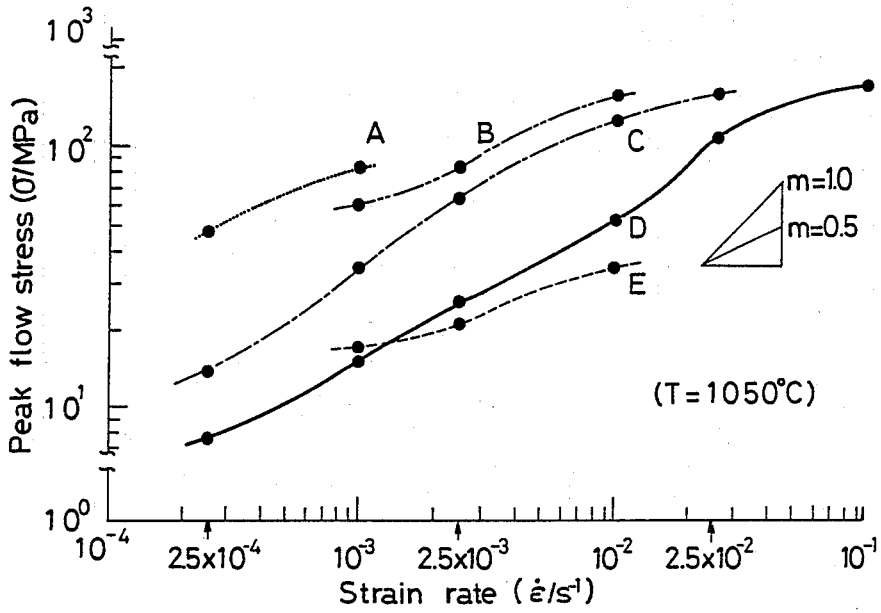
FIG. 3 is a graph showing the effect of strain rate on the peak flow stress of deformation at 1,050° C.
Figure 4:
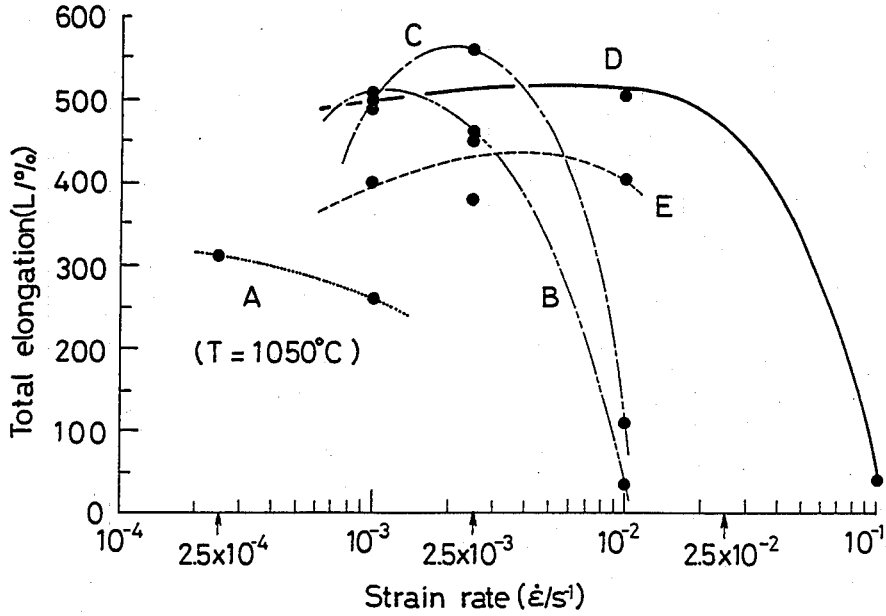
FIG. 4 is a graph showing the effect of strain rate on the total elongation of a specimen at 1,050° C.

FIG. 3 is a graph showing curves of m value obtained by finding the stress of deformation during the tensile test in terms of the top peak of the stress-strain curve and plotting the top peaks relative to the strain rates. FIG. 4 is a graph showing curves of the total elongation obtained simultaneously in the tensile test.

It is noted from these graphs that the stress of deformation decreased in the order of the material A, the group of materials B and C and the group of materials D and E and that the ductility conversely increased in the same order. No result is shown about the material H. Since the grain sizes of this material had the same diameter as those of the materials B and C, it is safe to conclude that the material H would have shown the same results as those of the materials B and C.

The results given above indicate that for a given material to manifest a desirable superplasticity, the extrusion temperature is desired to be not higher than 1,150° C. and the temperature of annealing for the purpose of recrystallization is desired to be not higher than 1,150° C. Particularly, in the group of materials B and C which used the annealing temperature of 1,150° C., the ductility was extremely degraded on the higher strain rate side even so much as to start showing a sign of embrittlement of texture. This phenomenon is a critical drawback for actual superplastic forging. In the case of the group of materials D and E, the ductility was observed to be lowered only minimally on the higher strain rate side as well as on the lower strain rate side. Even in the case of the material D, the m value was rather improved on the higher strain rate side, suggesting that the total elongation would further increase and reach its peak in the neighborhood of $2.0\times10^{-2}$ s$^{-1}$. This high m value deserves special attention in the light of the fact that the conventional IN-100, similarly to the materials B, C, and E, has the maximum m value on the order of 2 to $4\times10^{-3}\,s^{-1}$. This conspicuous difference between the materials D and E originated in the presence or absence of the annealing treatment at 1,070° C. for 1 hour. It is considered that this conspicuous difference between the material D and E would not have ensued if only the material E had been retained for at least 1 hour after it had reached the aforementioned prescribed temperature during the tensile test. In any event, the material D showed its maximum m value when the initial strain rate was in the neighborhood of $2.0\times10^{-2}\,s^{-1}$.

Where a specimen 50 mm in overall height is forged to a height of 15 mm at the strain rate mentioned above, the forging can be completed in about 36 seconds, whereas the conventional superplastic constant temperature forging takes about 6 minutes at the strain rate proper thereto. When the ordinary forging is enabled to retain the material at 1,050° C. for this period, it has no use for an expensive die of TZM and consequently for a voluminous vacuum chamber which would otherwise be required for the protection of TZM against oxidation due to exposure to the open air.

On the assumption that the retention of the material at the aforementioned temperature may be attained by the following dual measure:

(i) To enclose the material with an insulating metal made of an iron type alloy (S35C), for example, and prevent the temperature of the material from falling during the course of forging, and (ii) To use a die made of an inexpensive material and keep this die heated to a temperature in the range of 200° to 950° C., the following test was carried out.

Figure 5:
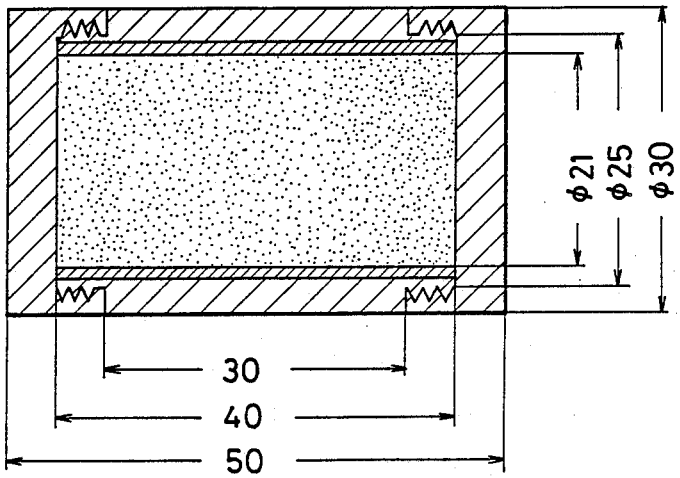
FIG. 5 is a cross section illustrating the shape of a billet before being formed in accordance with the present invention.

A die set made of a Ni-base alloy, Inconel 713C, was incorporated in a doughnut-shaped electric furnace and the dies were set in position between a crosshead and a bed of a 200-ton universal material tester. In this arrangement, the dies were kept heated to the neighborhood of 600° C, by means of the electric furnace and a material enclosed with an insulation metal of S35C shown in FIG. 5 (with the casing material used during the extrusion diverted as lateral sides thereof) and retained in advance at 1,100° C. for 10 minutes in a separate electric furnace was immediately (within 2 or 3 seconds) set between the aforementioned dies and then forged at a constant initial strain rate of $1.8\times10^{-2}\,s^{-1}$. The core temperature of the material was about 1,050° C. immediately before the forging.

For lubrication of the material being forged, a glass type lubricant (produced by Acheson Co., Ltd. and marketed under product code of "DG 347M") was applied in a thickness of 1 mm on the upper and bottom sides and on the lateral side. For lubrication of the dies, the same lubricant was applied in a thickness of 1 mm.

The material D was used for the test, with the materials F and G used for comparison.

Figure 6A:
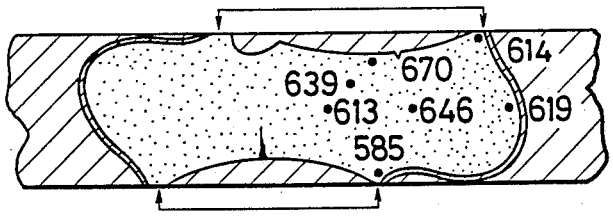
FIGS. 6(*a*), (*b*), and (*c*) are cross sections illustrating the shapes acquired by the billet after SWAP forging.
Figure 6B:
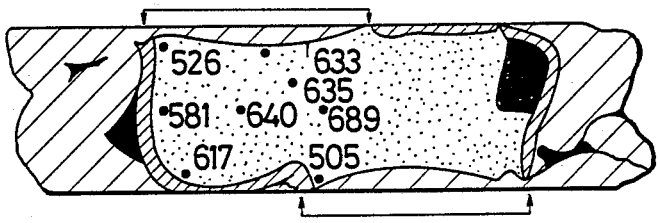
Figure 6C:
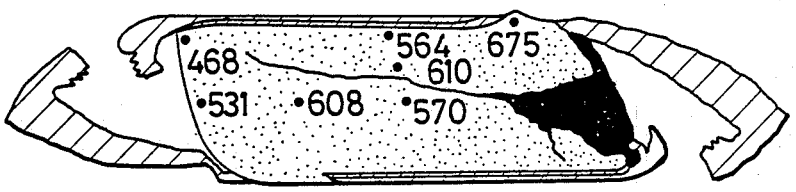

FIG. 6 is a schematic cross sections of the materials D, F, and G after the forging. The numerals shown in the diagram represent the magnitudes of Vickers hardness obtained at the indicated places by the five-point average method (300 gf×10S). The B.F. values indicated represent the magnitudes of Vickers hardness before the forging.

Figure 7:
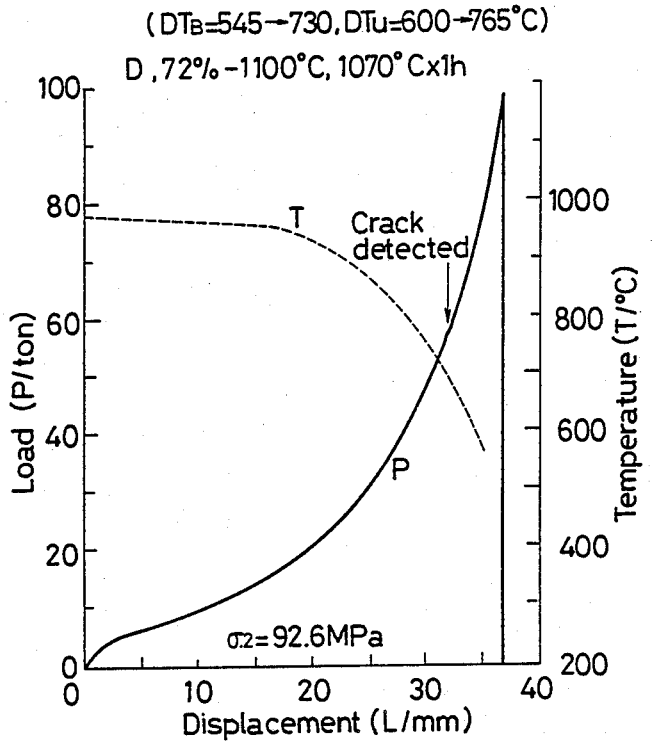
FIGS. 7–9 are graphs illustrating the load-displacement relations assumed by varying specimens during the course of SWAP forging.
Figure 8:
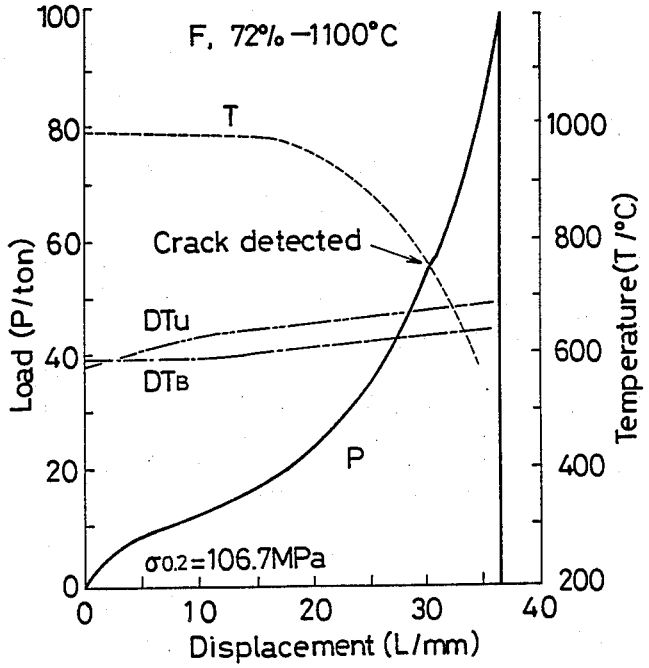
Figure 9:
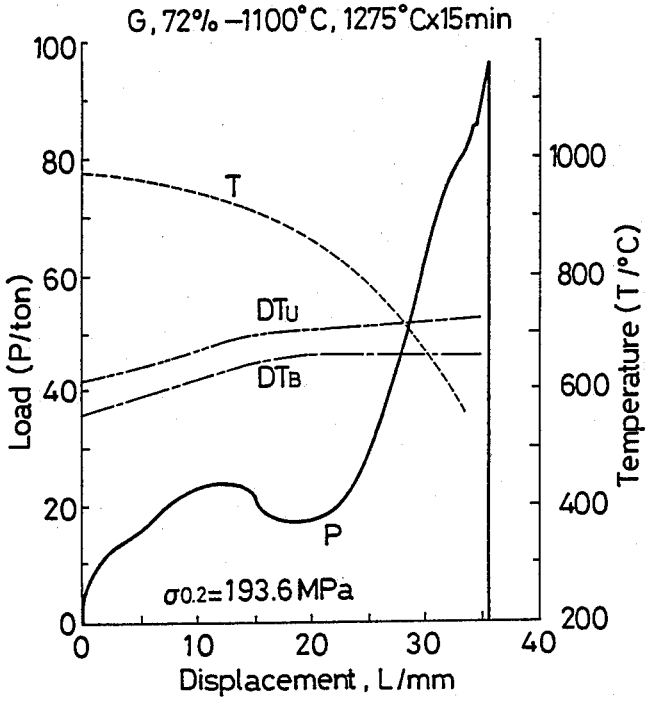

FIG. 7, FIG. 8, and FIG. 9 respectively show the load-displacement curves and the temperature variations obtained of the materials D, F, and G. In the graphs, the curves of dotted lines represent the temperatures on the lateral sides of the materials being forged as measured with a noncontact thermometer and DTu's and $DT_B$'s represent the results of the measurement of the inner temperatures of the upper die and the bottom die by the use of a thermocouple (PR) (in the case of FIG. 7, the temperature of the dies could not be measured during the course of forging). The proof stress 0.2% of each of the materials D, F, and G was found by subtracting the proof stress 0.2% of S35C and the cross-sectional area of S35C from the load corresponding to the strain 0.2% and dividing the difference by the cross-sectional area of IN-100.

For all the materials D, F, and G, the bed speed was $0.91\ mm.s^{-1}$, the limit of the tester used. This bed speed corresponds to a strain rate of $1.8\times10^{-2}\,s^{-1}$ when the height of the material is assumed to be 50 mm.

Figure 10:
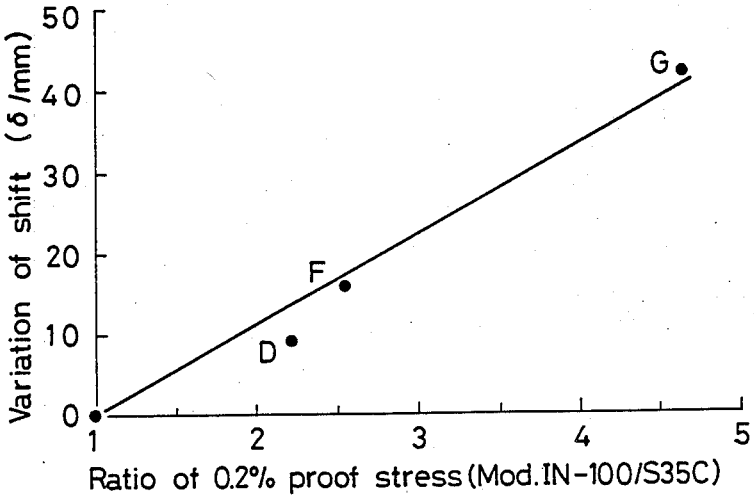
FIG. 10 is a graph showing the amounts of variation of shift exhibited by varying specimens.

Generally, on the three materials tested, signs of displacement due to buckling were seen to occur on the upper and bottom sides. The degrees of displacement increase in the order of the materials D, F, and G as shown in FIG. 10. This displacement is caused by the difference of the proof stress 0.2% between S35C, the material for the metallic insulator, and Mod. IN-100. The displacement tends to increase in proportion as the magnitude of the proof stress 0.2% of the Mod. IN-100 increases.

Now, the materials will be described individually.

In the material D, since the deformation advanced in a perfectly sticking state as shown by the arrow in FIG. 6, a heavy barreling occurred in the Mod. IN-100. Absolutely no defect was observed to ensue from the phenomenon of barreling. The temperature of the lateral sides notably declined during the middle phase of forging as shown in FIG. 7. This temperature drop is believed to have occurred because the stress of deformation of the S35C in the lateral sides increased so much as to induce an isostatic effect. The Mod. In-100 continued to possess high ductility. This fact possibly suggests that the deformation of the materials D followed the heavy strain due to the barreling without entailing any occurrence of a crack. This strain accompanying the barreling manifests itself as a magnitude of Vickers hardness approxmating saturation as shown in FIG. 6.

Further, one crack is seen to have occurred near the center of the boundary between the S35C and the Mod. In-100 in the lower part. If this crack occurred during the initial phase of the forging, then it ought to have grown to a considerable extend along with the advance of the deformation. The crack as shown, therefore, is believed to have occurred during the latter phase of forging, i.e. in the neighborhood of the arrow indicating the point of discontinuation in the curve of FIG. 7. A perfect wholesome material, however, was obtained when a ceramic refractory (a mixture of 47.3% of $Al_2O_3$ and 52.3% of $SiO_2$, produced by Isolite Bobcock Refractory Co., Ltd. and marketed under trademark designation of "Kao Wool") was interposed in a thickness of about 1 mm between the upper and bottom boundary surfaces of Mod. IN-100 and S35C shown in FIG. 5.

As regards the displacement in the material F, the deformation of the SUS 304 (one of the canning materials at the time of HIP) which existed from the beginning between the lateral sides of S35C and Mod. IN-100 was very small as compared with that of the material D. This fact implies that the volume of the strain in the lateral sides of Mod. IN-100 was not very large. This conclusion is supported by the fact that the Vickers hardness shown in FIG. 8 is small on the lateral sides and large in the diagonal directions producing displacement. In spite of this small strain, a large crack was produced in the lateral sides between the SUS 304 and the Mod. IN-100. This fact poses a problem.

The crack observed in the boundary between the S35C and the Mod. IN-100 in the lower part of the material being forged in FIG. 6 occurred at the same time as the crack in the material D.

Finally, in the material G, since the proof stress 0.2% of the Mod. IN-100 at the initial strain rate of $1.8\times10^{-2}\ s^{-1}$ far exceeds that of S35C, the displacement observed in the materials D and F does not occur in the Mod. IN-100 but occurs in the upper and bottom sides of S35C. This explains why the Mod. In-100 fell sideways. It is considered that this sidewise fall manifested itself as one of the peaks in the load-displacement curve of FIG. 9. Although this material was exposed to the same load of 100 tons as that used on the materials D and F, the Mod. In-100 is not believed to have been subjected to strain of any large amount because the surface of contact with the dies was large and because the magnitude of Vickers hardness after forging was relatively small as indicated in FIG. 6. The Mod. IN-100 by nature is a brittle material. The fact that a large crack occurred in the diagonal directions because of the small strain indicates that the material G is not fit at all for the SWAP forging.

In any event, the fact that the material D requires a very small load to undergo a fixed amount of deformation as compared with the materials F and F and the fact that it was amply deformed by barreling without entailing any defect indicate that the constant temperature forging heretofore inevitably requiring use of an expensive die of TZM can be effected by the use of any conventional inexpensive die. The merit of the use of this inexpensive die is believed to be very great.

EXAMPLE 2

In the atmosphere, a capsule of SUS 304 22 mm in inside diameter, 43 mm in depth, and 10 mm in thickness was filled to a real density ratio of about 65% with an atomized powder of Mod. IN-100–325 mesh in particle size having the composition of Table 1. The mass of the atomized powder in the capsule was evacuated to $5\times10^{-3}$ Torr and then tightly sealed with a lid of SUS 304 (4 mm in thickness).

The capsule packed with the powdery material was kept at 1,100° C. for 10 minutes in an electric furnace and then set in a die of Inconel 713C kept heated to about 600° C. in advance and forged under the same conditions as used in Example 1.

Figure 11:
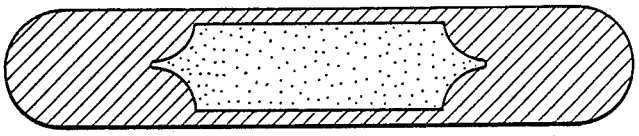
FIG. 11 is a schematic cross section of a powder material forged by the method of this invention.
Figure 12:
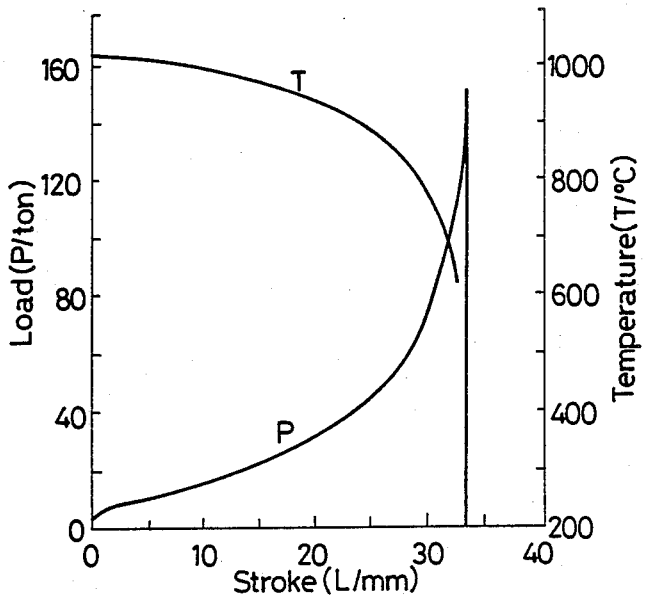
FIG. 12 is a graph showing the load-displacement curve in the specimen of FIG. 11.

FIG. 11 is a schematic cross section of a material after the forging and FIG. 12 shows the load-displacement curve and the variation of temperature.

In consequence of the foregoing, the material was consolidated throughout the entire surface and was seen to contain absolutely no void inside. The magnitude of hardness was equal to that of the HIP material.

What is claimed is:

1. A method for the forging of a high-strength low-ductility material, which comprises treating said high-strength low-ductility material thereby converting coarse grains thereof into hyperfine grains capable of manifesting superplasticity when the strain rate exceeds the level of $5\times10^{-3}\ s^{-1}$, enclosing said treated material with a metallic insulating member, heating said material enclosed with said metallic insulating member to a temperature at which said material manifests superplasticity, and forging said material by the use of a die kept during the forging in a state heated to a temperature not exceeding said temperature for manifestation of superplasticity.

2. A method according to claim 1, wherein said treatment of said material for conversion of coarse grains into hyperfine grains is effected by subjecting said material to plastic deformation in a state heated to a temperature not exceeding the recrystallization temperature and falling within 150° C. of said recrystallization temperature and subsequently annealing the deformed material by heating at about said recrystallization temperature.

3. A method according to claim 1, wherrein said metallic insulating member possesses ductility and strength equal or inferior to the strength of said die.

4. A method according to claim 3, wherein said metallic insulating member completely encloses said material.

5. A method according to claim 3, wherein said metallic insulating member partially encloses said material.

6. A method according to claim 5, wherein said metallic insulating member encloses the part of said material to be forged.

7. A method according to claim 1, wherein said temperature for manifestation of superplasticity falls in the range of 500° C. to 1,200° C.

8. A method according to claim 1, wherein said die is made of a material which has the temperature of the heated die as the upper limit of heat-resisting temperature.

9. A method according to claim 8, wherein said die is heated to a temperature in the range of 200° to 950° C.

10. A method according to claim 1, wherein said material is a bulk or powder material selected from the group consisting of Ni-base alloys, Ti-base alloys, high speed tool steel, ultra high carbon steel, and $\delta/\gamma$ duplex steel.

11. A method according to claim 10, wherein said Ni-base alloys include IN-100, MAR-M-200 and Rene 95.

12. A method according to claim 10, wherein said Ti-base alloys include Ti-6Al-4V.

* * * * *

UNITED STATES PATENT AND TRADEMARK OFFICE

CERTIFICATE OF CORRECTION

PATENT NO. : 4,867,807

DATED : Sep. 19, 1989

INVENTOR(S) : Yasunori Torisaka, et al

It is certified that error appears in the above-identified patent and that said Letters Patent is hereby corrected as shown below:

Title page:

The third inventor's name is incorrectly recorded, "Yoshinori Nakawawa", should be:

--Yoshinori Nakazawa--

Signed and Sealed this

Sixteenth Day of October, 1990

*Attest:*

HARRY F. MANBECK, JR.

*Attesting Officer*

*Commissioner of Patents and Trademarks*